United States Patent [19]

Keys

[11] Patent Number: 4,759,953

[45] Date of Patent: Jul. 26, 1988

[54] SEALED FOAM APPLICATORS

[75] Inventor: Steven F. Keys, Columbia City, Ind.

[73] Assignee: Essex Group, Inc., Fort Wayne, Ind.

[21] Appl. No.: 901,074

[22] Filed: Aug. 27, 1986

[51] Int. Cl.[4] ..... B05C 1/06; B05D 1/28

[52] U.S. Cl. ..... 427/117; 118/266; 118/267; 118/234; 427/429

[58] Field of Search ..... 118/234, 264, 267, 266; 427/429, 117

[56] References Cited

U.S. PATENT DOCUMENTS

| | | | |
|---|---|---|---|
| 4,359,963 | 11/1982 | Saito et al. | 118/260 X |
| 4,528,390 | 7/1985 | Kimura | 556/450 |
| 4,545,323 | 10/1985 | Keys | 118/268 |
| 4,573,428 | 3/1986 | Ogino et al. | 118/264 X |
| 4,601,918 | 7/1986 | Zaman et al. | 118/234 X |
| 4,604,300 | 8/1986 | Keys et al. | 427/120 |

FOREIGN PATENT DOCUMENTS

| | | | |
|---|---|---|---|
| 114371 | 12/1941 | United Kingdom | 118/264 |

*Primary Examiner*—John P. McIntosh

[57] ABSTRACT

The present invention discloses a felt applicator for applying a solution of lubricant to magnet wire, the applicator having at least one surface sealed to prevent the premature evaporation of the lubricant solvent during its passage through the applicator from the reservoir to the wire, resulting in more uniform distribution and quantity of the lubricant about the substrate.

8 Claims, 1 Drawing Sheet

SEALED FOAM APPLICATORS

TECHNICAL FIELD

The technical field to which this invention pertains is magnet wire coating apparatus and methods, particularly apparatus for applying lubricating coatings to magnet wire.

BACKGROUND ART

The practice of applying lubricating coatings to magnet wire, which then aids in inserting the resulting electrical coils into their respective housings, is well documented (note commonly assigned U.S. Pat. Nos. 4,385,435; 4,385,436; 4,385,437; 4,545,323 and 4,601,918 the disclosure of which are herein incorporated by reference). The application of such coatings has taken many forms but one form which has proven successful is the use of a wicking felt applicator which is in contact with both the lubricating solution and the magnet wire substrate to be coated. The lubricating solution is drawn into the felt applicator and wicked through the porous body of the applicator to a surface which is in contact with the wire. As the wire passes across and in contact with the surface of the applicator, the lubricating solution is transferred from the applicator surface to the wire. To form a uniform concentric coating, the wire may be drawn between two applicators surrounding the wire, thereby ensuring uniformity of thickness and concentricity. After the wire has been coated, the solvent used to carry the lubricant solids is evaporated, leaving a lubricating layer about the exterior of the magnet wire.

As disclosed in the referenced patents above, these lubricating solutions are typically very low in solids content. Additionally, they are in a solution of highly volatile aliphatic hydrocarbon solvents such as naphtha, heptane and hexane or mixtures of same.

A problem develops during the application of these lubricants onto the wire, which results in a buildup of the lubricant on the exposed surface of the applicator. This results in uneven distribution and application of the lubricant onto the wire substrate, overtime, and difficulty in controlling the amount of lubricant being applied to the wire. In certain applications where such lubricated wire is used (i.e. hermetically sealed refrigeration compressors, etc.) the amount of lubricant applied per pound of wire must be tightly controlled to prevent the lubricant (which may be removed by the solvent within the system) from clogging the filters or other sensitive components (capillaries) of the unit and thereby preventing it from working properly. The amount of lubricant to be placed on the wire is specified by the manufacturer and is defined as the cleanliness number. This number is defined as the amount of lubricant by weight placed on a specified weight of wire. Typical units used to specify such a requirement is milligrams of lubricant per pound of wire (mgm/lb). These specifications are most often described in terms of maximum quantities of lubricant as too much lubricant is more harmful to the system than too little. Oftentimes these cleanliness numbers are difficult to attain due to the nonuniform application of the lubricant.

Additionally it has been found that the applicator often contains residual lubricant particles, which are now in a highly viscous, high solids condition. As the wire passes in contact with the applicator, this material will periodically be transferred from the applicator to the wire, again forming a nonuniform application of the lubricant and increasing the cleanliness number of the resulting wire.

Therefore, what is required in the art is a felt applicator which permits more uniform application of the lubricant to the wire, both in distribution and quantity, thereby producing a wire with lower and more consistent cleanliness numbers.

DISCLOSURE OF THE INVENTION

What is proposed is a felt applicator which is porous internally and has the ability to wick the lubricating solution from the reservoir to the applicator surface yet has one or more of the surfaces sealed to substantially prevent evaportion of the lubricating solution solvent. This results in a more uniform lubricating solution being applied to the wire substrate resulting in a more uniformly lubricated wire and more consistent and lower cleanliness numbers.

In addition to the applicator itself, a method for lubricating magnet wire utilizing this felt applicator is also disclosed.

The inventor has determined that much of the cause for the nonuniformity of the lubricant on the wire is caused by premature evaporation of the solvents as the lubricant passes through the porous applicator. The internal porosity of these applicators is obviously necessary for the passage of the lubricating solution from the reservoir to the wire applicating surface. However, traditionally the felt applicators used have porous surfaces on all the surfaces of the applicator. Therefore, the lubricating solution, as it is being wicked from the reservoir to the applicating surface of the applicator through the porous felt, eventually wicks its way to all the surfaces of the applicator thereby saturating the applicator. Once the applicator has become saturated with the lubricating solution, and this lubricating solution has reached at least one of the surfaces of the felt, the amount of solvent evaporation becomes significant. The present invention prevents this from occurring, resulting in improved product wire.

Other features and advantages of the present invention will become more apparent from the specification and claims and from the accompanying drawings which illustrate an embodiment of the invention.

BEST MODE FOR CARRYING OUT THE INVENTION

Figure 1:
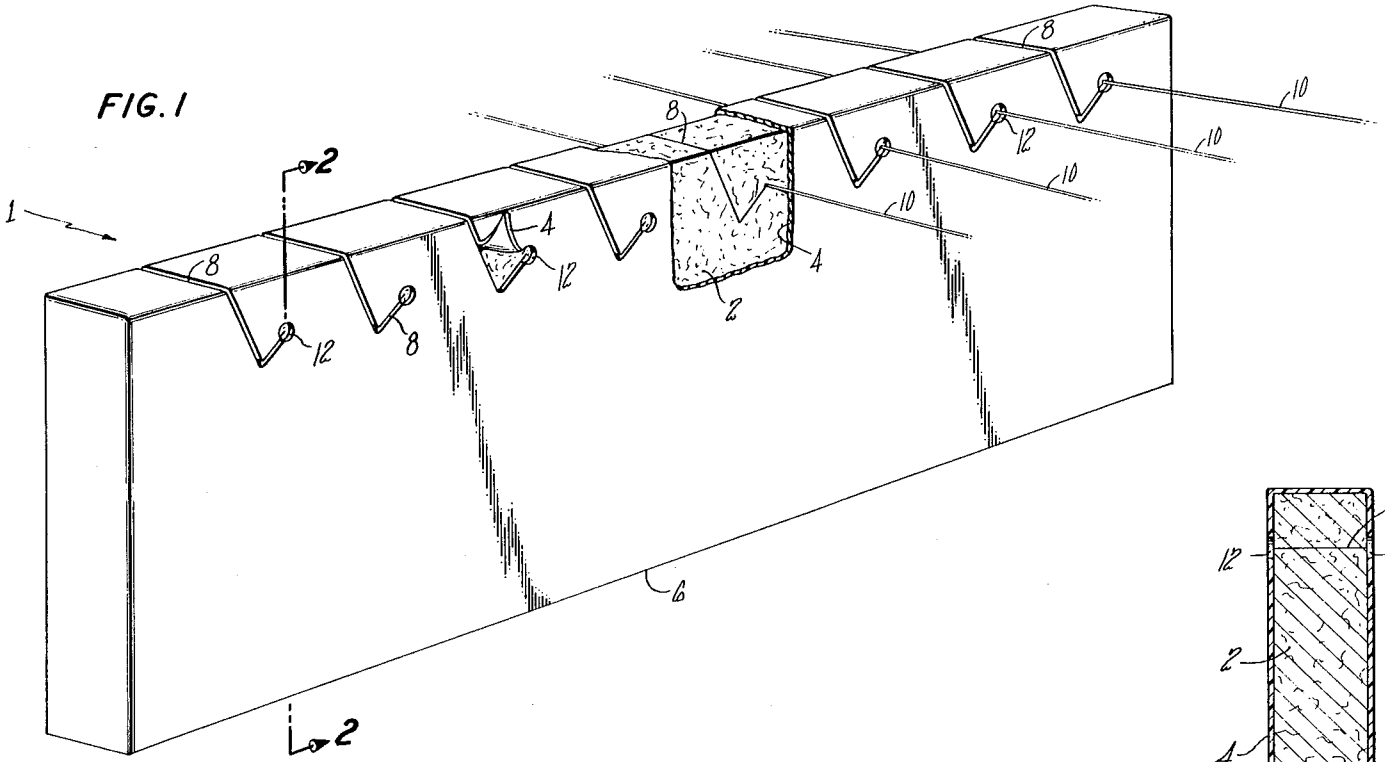
FIG. 1 is a drawing of a typical applicator of the present invention.

The porous applicators useful in practicing this invention may be any of the conventional felt applicators which are used in the magnet wire industry. Traditionally, these are made from wool or other materials in conventional felt form. Such materials are described in commonly assigned, copending patent application U.S Ser. No. 769,902, (now U.S. Pat. No. 4,601,918) the disclosure of which is incorporated herein.

However, the term porous applicator as used in this application should not be so limited and the term is meant to be more functional in nature to describe a pad-like structure which allows for the passage of the lubricating material through the applicator and onto the wire via wicking. Therefore, a number of nonconventional porous products having this property may be used in place of the traditional felt materials. For instance, the applicator may be formed of almost any open cell material such as polyethylene, polyurethane, polyimide or polypropylene which will be solvent compatible with the lubricant and will wick or draw the material through its body from a reservoir to the wire. Typically these materials will have a porosity measured in pores per inch (ppi) and should range greater than 10 ppi with greater than 50 ppi being preferred. The pore concentration will allow for sufficient wicking ability within the applicator. Usually the greater the pore per inch, the greater the wicking ability of these applicators.

Of course one of the primary qualities which these porous applicators must posses is that they should be resistant to attack by the materials used to manufacture the lubricants or any solvents used to carry the lubricants in solution. In addition, the porous material must be compliant enough to be capable of applying a smooth uniform concentric layer of lubricant onto the wire substrate.

The particular size and design features of these porous applicators will vary depending on the needs of a particular apparatus. These porous applicators are generally housed in fixtures which are designed for a particular machine and each machine may have its own particular design features. Therefore, depending on the housing, the porous applicator will be designed accordingly, i.e. dimensions, porosity, etc. Typical porous materials useful in practicing the invention are felt pads formed of wool and defined by conventional felt manufacture specifications between F-1 to F-10 and having densities of about 0.181 gm/cc to about 0.342 gm/cc based on 100 percent wool sample. It should be apparent that in these lubricating processes, the applicator performs the same function, but each applicator design will have a different design requirement. These design requirements are known to those skilled in the art and would be conventional.

An improved applicator, which produces a superior process of applying lubricating material to magnet wire, can be designed by sealing the surfaces of such porous applicators to prevent evaporation or passage of the lubricating solution from these surfaces. This may be done in any number of ways depending on the applicator material. When using a foam material for an applicator, sealing the surfaces may be accomplished by manufacturing the foam so that it has a nonporous skin layer on those surfaces desired. Alternatively, the resulting foam structure may have its surfaces sealed by exposure of those surfaces to be sealed to heat or solvents, thereby causing the upper layer of cells to seal themselves. These methods are conventional.

Another method which is more generic in its application to any number of application materials is to apply a layer of sealant material to the surfaces which are to be sealed. Some materials which may be used would be epoxy resin, polyethylene film, nitrile rubber, polyurethane or mylar films. These materials may either be first formed into sheets or films and then laminated or bonded to the surface of the porous applicator or wrapped about it to encapsulate the desired surface or shrink fitted about the applicator. Or in the alternative, the materials may be applied as liquids to the surface of the applicator and then cured to form a sealed surface. (It should be noted that when sealing with a liquid material, the sealant should not be allowed to penetrate too deeply into the surface being coated or it will impair the efficiency of the applicator to wick the lubricant from the reservoir to the wire. This may be accomplished by using the sealant in a highly viscous state.) These liquid materials may be applied in a conventional manner, such as brush, dip, spraying or by flat applicator such as a tongue depressor.

Clearly, there are any number of methods which are now known and surely some which will be developed later to seal such surfaces. Again, the principal concept is that by sealing the exposed surfaces of these felt applicators, the evaporation rate of the solvents used in the lubricating solution will be significantly reduced thereby maintaining the solution at the proper concentration and reducing lubricant buildup on the porous applicator thereby resulting in an applicator which will allow for greater control over the quantity and uniformity of the lubricant deposited on the wire.

The rationale behind the improved performance is that the object of the applicator is to supply, at a continuous and constant rate and in a uniform concentration, the lubricant solution to the wire substrate. However, the solvents used in these lubricant solutions are very volatile (to allow air drying) and as a lubricating solution is wicked or forced through the applicator, the applicator becomes saturated. Therefore, at the exposed surface areas which are not directly involved in the transport of the lubricant, or the application of the lubricant directly onto the wire, a surprisingly high amount of solvent is evaporated from the solution prior to its wicking onto the wire. This alters the concentration of the lubricant solution producing a nonuniform lubricating layer on the wire. Therefore, by reducing the evaporation of the solvent from these nonapplication surfaces, the solution remains more uniform during its passage through the applicator to the application point.

In order to determine the effectiveness of the invention, a porous pad applicator 2 was prepared (FIG. 1) which was made of 100 percent wool felt of F-1 classification, 8 pounds per square yard. The applicator 2 was ½ inch thick, about 4 inches wide and about 7 inches long. The applicator 2 was wrapped in 0.014 inch urethane film 4 backed with a pressure sensitive polyurethane adhesive. The surface 6 in contact with the reservoir had the film 4 removed to allow the lubricant to wick into the applicator (FIG. 2).

Figure 2:
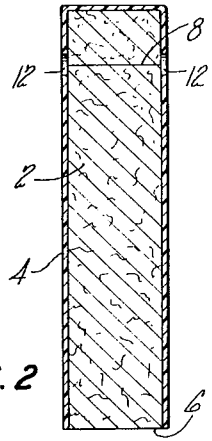
FIG. 2 is a cross-sectional view of a typical applicator of the present invention.

As is shown in FIG. 1, slots 8 were then made in the front of the coated applicator 1 to allow the wires 10 to be positioned in contact with the applicator 2. In addition, the immediate area 12 about the wire had the covering 4 removed because the inflexibility of the material could, if in contact with the wire, remove the lubricant. (However, this may not be necessary if the material sealing the applicator is compliant enough not to remove the lubricant.)

A 2 percent solution of lubricant was applied to a 16 gauge aluminum wire using felt applicators of the same construction, one felt applicator unsealed and one sealed as discussed supra. The applicator ran for 24 hours and the results of the testing are shown in the table below:

| Applicator | Cleanliness number | Standard Deviation per reel over 8 reels of wire |
|---|---|---|
| Sealed | 23.75 mg/pound | 5.44 |

-continued

| Applicator | Cleanliness number | Standard Deviation per reel over 8 reels of wire |
|---|---|---|
| | of wire | |
| Unsealed | 48.15 mg/pound of wire | 17.75 |

The cleanliness numbers are determined by weighing the wire prior to and after the application of the lubricant. The amount of lubricant applied per pound of wire is then computed and this is the cleanliness number. As may be seen from this data, the amount of lubricant applied is less with the sealed applicator than with the unsealed one. In addition, eight reels were run and the amount applied to each was much more uniform from reel to reel as demonstrated by the standard deviation.

A second test was performed with a sealed applicator of the same configuration in which the sealed applicator was used for seven days resulting in an average of 29.25 mg/lb of wire while an unsealed applicator was applying an average of 53.03 mg/lb of wire. (The amount of lubricant applied typically increases with time when using an unsealed felt, while it remains constant using the sealed applicators.)

In addition, an applicator having the same dimensions and of the same material was sealed with a layer of epoxy material. During a similar 24 hour test using the same lubricant material and wire, the epoxy sealed applicator applied 20.9 mg/lb of wire at a standard deviation of 3.06, again much lower than any unsealed applicator.

The cleanliness numbers achieved by these applicators are paticularly significant since the specification for this particular wire is 42 mg/lb of wire or lower. Therefore, the manufacture of the wire is much more easily achieved with the new sealed applicator than with the unsealed ones.

The ability to prevent evaporation causing the lubricating solution concentration to remain constant also allows lubricating operation to be run at concentrations above the level used with the unsealed felt applicators, this increase being about double, yet still maintain the proper film thickness and concentricity.

It should be understood that the invention is not limited to the particular embodiments shown and described herein, but that various changes and modifications may be made without departing from the spirit and scope of this novel concept as defined by the following claims.

What is claimed is:

1. A porous applicator for applying magnet wire coatings containing volatile solvents the improvement comprising a porous applicator having substantially all its surfaces sealed to prevent the passage therethrough of the solvents, said applicator having a least one opening in at least two of the sealed surfaces to allow a magnet wire to pass through and contact the applicator, thereby applying magnet wire lubricating coating to the wire and at least one opening in one of the sealed surfaces to allow for the introduction of the magnet wire lubricating coating into the applicator.

2. The article of claim 1 wherein the felt applicator surfaces are sealed by encapsulating said surfaces in shrink film.

3. The article of claim 2 wherein the shrink film is polyethylene.

4. The article of claim 1 wherein the surfaces have been sealed by bonding a layer of urethane film to their surface.

5. The article of claim 1 wherein the porous applicator comprises an open cell foam material.

6. The article of claim 5 wherein the open cell foam material is selected from the group consisting of polyurethane, polyethylene and polyimide.

7. The article of claim 5 wherein the sealed surfaces have been formed by forming a skin on the surface to be sealed.

8. In a method for applying a lubricating solution in a volatile solvent to magnet wire wherein the improvement comprises sealing substantially the entire surface of a porous applicator so as to substantially prevent the evaporation of solvent from the lubricating solution through the sealed surface, providing at least two openings in the sealed surface to allow a magnet wire to contact the porous applicator thereby applying magnet wire lubricating coating to the wire, passing the wire through said openings in contact with said porous applicator and providing at least one opening in one of the sealed surfaces to allow for introduction of the lubricating solution into the applicator, and introducing lubricating solution through the at least one opening.

* * * * *